United States Patent [19]

Jones et al.

[11] Patent Number: 4,855,697

[45] Date of Patent: Aug. 8, 1989

[54] COAXIAL TRANSMISSION LINE TO MICROSTRIP TRANSMISSION LINE LAUNCHER

[75] Inventors: Keith E. Jones, Aloha, Oreg.; Warren K. Harwood, Vancouver, Wash.

[73] Assignee: Cascade Microtech, Inc., Beaverton, Oreg.

[21] Appl. No.: 212,309

[22] Filed: Jun. 27, 1988

[51] Int. Cl.[4] ..... H01P 5/08

[52] U.S. Cl. ..... 333/33; 333/260

[58] Field of Search ..... 333/21 R, 33, 246, 260

[56] References Cited

U.S. PATENT DOCUMENTS

| | | | |
|---|---|---|---|
| 3,553,607 | 1/1971 | Lehrfeld . | |
| 3,622,915 | 11/1971 | Davo . | |
| 3,662,318 | 5/1972 | Decuyper | 333/33 X |
| 3,686,624 | 8/1972 | Napoli et al. . | |
| 3,705,379 | 12/1972 | Bogar . | |
| 3,725,829 | 4/1973 | Brown . | |
| 4,280,112 | 7/1981 | Eisenhart | 333/21 R |
| 4,669,805 | 6/1987 | Kosugi et al. | 333/21 R X |

FOREIGN PATENT DOCUMENTS

| | | | |
|---|---|---|---|
| 1195402 | 11/1985 | U.S.S.R. | 333/33 |

*Primary Examiner*—Paul Gensler

*Attorney, Agent, or Firm*—Chernoff, Vilhauer, McClung & Stenzel

[57] ABSTRACT

A launcher having an outer conductor and a tapered central contact pin within a bore of the outer conductor connects coaxial transmission lines with microstrip transmission lines. The launcher, when used with a microstrip transmission line having a specific dielectric substrate thickness, provides matching of both the characteristic impedance and the electro-magnetic field configuration. The launcher also may be used effectively with microstrip transmission lines having different substrate thickness. An adjustable stop transversely positions the upper surface of the microstrip transmission line relative to the launcher's outer conductor to conteract capacitive discontinuities caused by different substrate thickness. Although such adjustments flex the central contact pin transversely, thus changing the launcher's characteristic impedance, the launcher provides better overall matching between the two types of transmission lines. The contact tip of the pin has a cylindrical contact surface coaxial with the pin, thus forming a repeatable line contact with the upper conductor of the microstrip transmission line enabling consistent results. The bore of the outer conductor is at an angle with respect to the coaxial transmission line jack, allowing the tapered pin to extend coaxially with the jack so that the pin can be drilled and tapped on its center axis, simplifying its mass production.

8 Claims, 1 Drawing Sheet

COAXIAL TRANSMISSION LINE TO MICROSTRIP TRANSMISSION LINE LAUNCHER

BACKGROUND OF THE INVENTION

The present invention pertains to the field of devices which provide electrical connection between coaxial transmission lines and microstrip transmission lines.

Ideally, such a device, or "launcher," allows high-frequency signals to pass therethrough without causing reflections and corresponding power loss. Signal reflections are minimized by matching the characteristic impedances and electro-magnetic field configurations of both the coaxial transmission line and the microstrip transmission line.

Some early launchers are described in Lehrfeld, U.S. Pat. No. 3,553,607, Napoli, et al., U.S. Pat. No. 3,686,624, and Brown, U.S. Pat. No. 3,725,829. In each of these early launchers, an extension of a coaxial transmission line's center conductor is forced against a microstrip transmission line's upper conductor, and an extension of the coaxial transmission line's outer conductor electrically couples with the microstrip transmission line's lower conductor.

In each of these launchers, the electromagnetic field configuration changes abruptly at the point of contact with the microstrip transmission line. Bogar, U.S. Pat. No. 3,705,379, shows a launcher which lessens the abrupt change in electro-magnetic field configuration. An extension of the center conductor of the coaxial transmission line has a lanced-out portion which is offset downward relative to the extension of the outer conductor. The launcher of Davo, U.S. Pat. No. 3,622,915 uses a ramp-like member to further reduce any discontinuities in electromagnetic field configuration. However, both the Bogar and the Davo devices improve the electromagnetic field distribution at the expense of losing the constant characteristic impedance.

A launcher is disclosed in Eisenhart, U.S. Pat. No. 4,280,112, the purpose of which is to eliminate discontinuities in both the characteristic impedance and the electromagnetic field configuration. By gradually displacing a center conductor contact pin of gradually diminishing diameter from the center axis of an outer conductor of constant diameter, the launcher maintains a constant characteristic impedance while transforming the electromagnetic field configuration between a coaxial transmission line configuration and a microstrip transmission line configuration. Such device, however, does not solve all of the problems facing launcher design. The launcher is optimized for a microstrip transmission line having a specific dielectric substrate thickness; if used with a microstrip transmission line having a different dielectric substrate thickness, capacitive discontinuities occur at the junction, resulting in greatly decreased performance. Moreover, there is no way to compensate for manufacturing variations of pin and bore diameters. The launcher also has a cantilevered contact pin tip with a flat contact surface to provide maximum surface area to contact the upper conductor of a microstrip transmission line. Due to manufacturing variations, the actual contact surface may be either an edge (caused by slight axial twisting of the contact pin) or three points of the contact pin's lower surface. These contacts yield different results, yet are not easily repeatable. Finally, mass production of the cantilevered contact pin is difficult because the end of the pin opposite the contact tip must be drilled and tapped at a precise angle relative to the pin's axis.

SUMMARY OF THE INVENTION

Although a launcher according to the present invention is optimized for use with a microstrip transmission line having a specific substrate thickness, it may also be used effectively with microstrip transmission lines having different substrate thicknesses. An adjustable stop variably positions the upper surface of the microstrip transmission line relative to the launcher's outer conductor. The adjustable stop may be moved transversely relative to the bore axis of the outer conductor to counteract capacitive discontinuities caused by different substrate thicknesses. Although such adjustments also flex the launcher's contact pin transversely, thus changing the launcher's characteristic impedance, the launcher gives better overall matching between the two types of transmission lines. Such adjustability can also be used to provide precise pin and bore alignment despite manufacturing variations in pin and bore diameters.

The contact tip of the tapered contact pin has a cylindrical contact surface having an axis extending longitudinal of the pin. The elongate pin thus forms a line contact with the upper conductor of the microstrip transmission line. This line contact is repeatable, allowing for consistent results.

Furthermore, the axis of the bore of the outer conductor is at an angle with respect to the coaxial transmission line. This angle allows the tapered pin to extend coaxially with the coaxial transmission line connector. The tapered pin may thus be drilled and tapped on axis, simplifying its mass production.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 1:
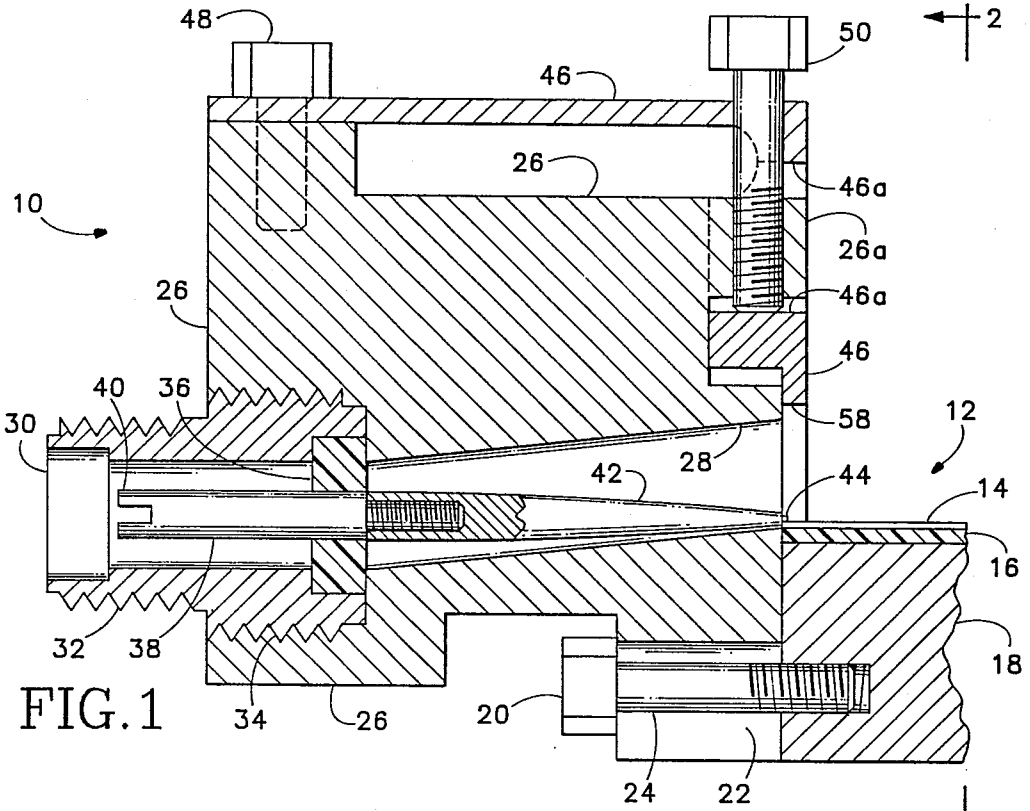
FIG. 1 is a sectional side view of an exemplary embodiment of a launcher according to the present invention attached to a microstrip transmission line.
Figure 4:
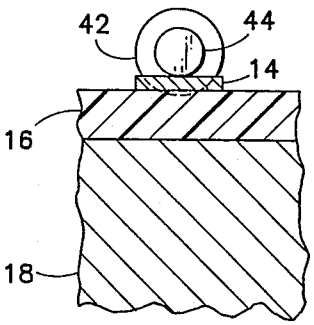
FIG. 4 is an enlarged front sectional view taken along line 4—4 of FIG. 3.
Figure 3:
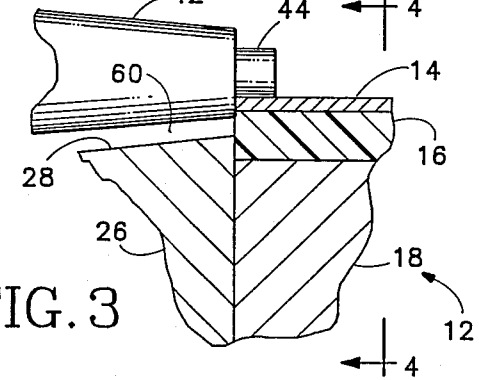
FIG. 3 is an enlarged sectional side view of the contact tip of the launcher engaged with the microstrip transmission line.

Referring to the drawings, wherein like reference numerals refer to like elements, and with particular reference to FIG. 1, a launcher 10 is attached to a microstrip transmission line 12. Hereinafter, "front" will refer to the side of the launcher 10 facing the microstrip transmission line, which is the right side in FIG. 1, while "back" will refer to the opposite side of the launcher 10 facing the coaxial transmission line, or the left side in FIG. 1. The microstrip transmission line 12 comprises an upper conductive strip 14, a dielectric substrate 16, and a lower conductive plate 18. The lower conductive plate 18 is drilled and tapped to accept two threaded bolts 20. The launcher 10 comprises a conductive body 26 having a bore 28 extending therethrough between its front and back sides. The body 26 has two parallel, open-bottomed vertical slots 22 slidably accepting the shanks 24 of the threaded bolts 20 when the bolts are loosened. At the back end of the bore 28 is a tubular coaxial jack 30, which has a first threaded portion 32 for receiving an outer conductor of a coaxial transmission line and a second threaded portion 34 for engaging with the conductive body 26. The diameter of the second threaded portion 34 is large enough that the bore 28 can be drilled completely through the body 26 without damaging the threads which engage with the second threaded portion 34. An annular dielectric spacer 36 secures a central receiving pin 38 coaxially within the interior of the jack 30, the back end 40 of the pin being adapted to engage with a center conductor of a coaxial transmission line. A tapered contact pin 42 is attached to the central receiving pin 38 and extends coaxially therewith. Although the tapered pin 42 is centered within the bore 28 at the bore's back end, it gradually becomes offset relative to the bore because of the bore's angled axis relative to the coincident axes of the jack 30 and pins 38 and 42, respectively, nearly touching the wall of the bore 28 at the bore's front end. The diameter of the bore 28, the varying diameter of the tapered pin 42, and the tapered pin's gradually offset position relative to the axis of the bore 28 are set according to a known formula to maintain a constant characteristic impedance throughout the length of the bore 28. This known formula is given in Eisenhart, U.S. Pat. No. 4,280,112, and at page 247 of the book *Complex Variables and Applications* by Ruel V. Churchill (Second Edition, McGraw Hill, 1960), both of which are hereby incorporated by reference. At the front end of the tapered pin 42 is a contact tip 44 for electrically contacting the upper conductor 14 of the microstrip transmission line 18. As shown in FIGS. 3 and 4, the contact tip 44 is cylindrical and coaxial with the tapered pin 42, making a line contact with the upper conductor 14. This line contact is repeatable, allowing for consistent results with repeated uses of the launcher. The coaxial arrangement of tapered pin 42, cylindrical contact tip 44, and central receiving pin 38 allow the tapered pin 42 to be mass produced simply. It can be turned on a lathe and drilled and tapped, all on its center axis.

The relationship between the diameter of the contact tip 44 and the width of the upper conductor 14 is such that virtually all capacitive effects are caused by interaction between the upper conductor 14 and the lower conductive plate 18, rather than by interaction between the contact tip 44 and the lower conductive plate 18. For example, for a microstrip transmission line with a ten mil thick alumina substrate 16 and a ten mil wide upper conductive strip 14, the contact tip has a diameter of eight mils.

Returning to FIG. 1, a generally L-shaped adjustable stop 46 has a resilient top leg attached to the top of the conductive body 26 by bolts 48, and a front leg extending downwardly over the front of the conductive body having a rectangular aperture **46*a* formed therethrough. Slidably passing through the aperture 46*a* is a threaded extension 26*a* of the conductive body 26. A threaded adjustment bolt 50 passes slidably through the top leg of the stop 46 and threadably through the threaded extension 26*a*, abutting the bottom of the aperture 46*a* to force it downwardly against the upward biasing force of the-resilient top leg of the stop 46. The position of the adjustable stop 46 relative to the bore 28 may thus be adjusted up or down by turning the adjustment bolt 50**.

Figure 2:
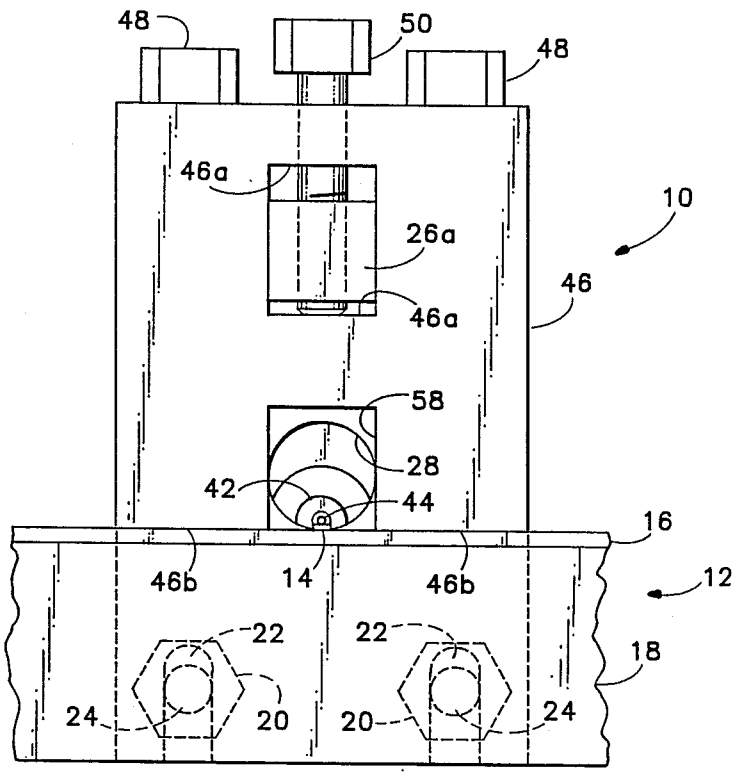
FIG. 2 is an elevational front view taken along line 2—2 of FIG. 1.

Referring to FIG. 2, the adjustable stop 46 has an open-bottomed rectangular slot 58 which surrounds the front of the bore 28, with the lower edge **46*b* of the adjustable stop 46 abutting the upper surface of the dielectric substrate 16. In use, the adjustable stop 46 is moved to a predetermined location by turning the adjustment bolt 50. A microstrip transmission line 12 is forced upwardly against the lower edge 46*b* of the adjustable stop with the bolts 20 loosened, and then held in place by tightening the bolts 20. To readjust the position of the microstrip transmission line 12, the bolts 20 are loosened and the adjustment bolt 50 is turned while the transmission line is held upward against the stop 46, after which the bolts 20 are retightened. In this manner, adjusting the transverse position of the adjustable stop 46 also adjusts the transverse position of the microstrip transmission line 12 relative to the bore 28. As an alternative to the foregoing continuously adjustable structure, an incrementally adjustable structure employing a plurality of thin, horizontal, stacked shims insertable interchangeably above and below the extension 26*a* could be employed without need for the adjustment bolt 50**.

Referring again to FIG. 3, the contact tip 44 of the tapered pin 42 contacts the upper conductive strip 14 of the microstrip transmission line 12, while the portion of the conductive body 26 which is just below the bore 28 contacts the lower conductive plate 18 of the transmission line 12. To maximize impedance matching at the contact tip 44, the gap 60 between the tapered pin 42 and the conductive body 26 at the front end of the tapered pin 42 should be approximately one half the thickness of the dielectric substrate 16. This gap-thickness relationship is achieved by moving the microstrip transmission line 12 up or down with respect to the bore 28, employing the adjustment procedure described above. The tapered pin 42 can flex to The geometry of the launcher 10 is optimized for use with microstrip transmission lines 12 having a predetermined substrate thickness which meets the aforementioned gap-thickness relationship when the tapered pin 42 is positioned optimally to maintain the characteristic impedance through the length of the bore 28. When the launcher 10 is used with a microstrip transmission line 12 having a different substrate thickness, obtaining the required gap-thickness relationship requires yieldably moving the front end of the tapered pin 42 out of such predetermined optimum position relative to the axis of the bore 28. Although this alters the characteristic impedance throughout the length of the bore 28, the overall signal reflections are decreased, improving performance. The adjustable stop 46 also allows errors, introduced in the pin and bore diameters by manufacturing tolerances, to be corrected.

The adjustable stop 46 can be optimally adjusted for a specific microstrip transmission line 12 using a time domain reflectometer. The reflectometer is connected to the launcher 10 which is connected to a terminated microstrip transmission line 12. The launcher is successively tested and adjusted until any reflected signals are minimized.

Similarly, power transmission may be tested and optimized by connecting a short microstrip transmission line 12 between two launchers, preferably one of which has been previously optimized for the thickness of the dielectric substrate 16. A network analyzer may be used to measure signal reflections or transmission, and launcher adjustments may likewise be made until power transmission is maximized.

The terms and expressions which have been employed in the, foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A launcher for connecting a coaxial transmission line having inner and outer conductors to a microstrip transmission line having a planar upper surface and upper and lower conductors, said launcher comprising:

(a) an electrically conductive body having first and second ends and a bore therebetween, said bore having a bore axis, said first end of said conductive body being adapted for coupling with the outer conductor of the coaxial transmission line, and said second end of said conductive body being adapted for coupling with the lower conductor of the microstrip transmission line;

(b) an electrically conductive elongate pin having first and second ends and a longitudinal axis, said first end of said conductive pin being adapted for connecting to the inner conductor of the coaxial transmission line, and said second end being adapted for contacting the upper conductor of the microstrip transmission line;

(c) holding means for holding said pin within said bore of said conductive body such that said longitudinal axis of said pin extends at a predetermined angle relative to said bore axis; and (d) variable-position stop means for variably positioning the microstrip transmission line relative to said bore along a direction generally transverse to said elongate pin and perpendicular to said upper surface of said microstrip transmission line, said stop means comprising means adjustably movable with respect to said conductive body for abutting said upper surface of said microstrip transmission line at variable positions of said upper surface, relative to said conductive body, along said direction.

2. The launcher of claim 1 wherein said variable-position stop means includes means for variably positioning said second end of said pin relative to said bore along said direction in unison with the positioning of said transmission line relative to said bore.

3. The launcher of claim 1 wherein said second end of said conductive pin is cylindrical.

4. A launcher for connecting a coaxial transmission line having inner and outer conductors to a microstrip transmission line having a planar upper surface and upper and lower conductors, said launcher comprising:

(a) an electrically conductive body having first and second ends and having a bore therethrough between said first and second ends, said first end of said conductive body including coupling means, having a coupling axis, for coupling with the outer conductor of the coaxial transmission line so that said coupling axis is coaxial with with said coaxial transmission line, and said second end of said conductive body having means adapted for coupling with the lower conductor of the microstrip transmission line, said bore having a bore axis and said coupling axis extending at a predetermined skewed relation to said bore axis, (b) an electrically conductive elongate pin having first and second ends and a longitudinal axis, said first end of said conductive pin having means for connecting to the inner conductor of the coaxial transmission line, and said second end having means for contacting the upper conductor of the microstrip transmission line;

(c) holding means for holding said pin within said bore of said conductive body such that said longitudinal axis of said pin extends coaxially with said coupling axis and at said predetermined skewed relation to said bore axis; and (d) stop means for positioning the microstrip transmission line relative to said bore along a direction generally transverse to said elongate pin.

5. The launcher of claim 4 wherein said second end of said conductive pin is cylindrical.

6. The launcher of claim 4 wherein said stop means includes means for variably positioning the microstrip transmission line relative to said bore along said direction and generally perpendicularly to said upper surface of said microstrip transmission line, said stop means comprising means adjustably movable with respect to said conductive body for abutting said upper surface of said microstrip transmission line at variable positions of said upper surface, relative to said conductive body, along said direction.

7. A method of minimizing signal reflection caused by mismatched impedances of a coaxial transmission line, a microstrip transmission line having a planar upper surface, and a coupling launcher operably interposed therebetween having a bore and a variable-position stop movably mounted thereon in abutment with said upper surface for adjustably positioning the microstrip transmission line relative to the bore along a direction generally transverse to said bore and perpendicular to said upper surface, said method comprising the steps of:

(a) providing a stimulus signal to one of said coaxial transmission line and said microstrip transmission line;

(b) sensing the magnitude of the signal reflection; and (c) moving said stop and said microstrip transmission line in unison along said direction so as to minimize the magnitude of said signal reflection.

8. A method for maximizing power transmission between a coaxial transmission line and a microstrip transmission line, having a planar upper surface, operably interconnected via a coupling launcher having a bore and a variable-position stop movably mounted thereon in abutment with said upper surface for adjustably positioning the microstrip transmission line relative to the bore along a direction generally transverse to said bore and perpendicular to said upper surface, said method comprising the steps of:

(a) providing a stimulus signal to one of said coaxial transmission line and said microstrip transmission line;

(b) sensing the power transmitted between said coaxial transmission line and said microstrip transmission line; and (c) moving said stop and said microstrip transmission line in unison along said direction so as to maximize said power.

* * * * *

UNITED STATES PATENT AND TRADEMARK OFFICE

CERTIFICATE OF CORRECTION

PATENT NO. : 4,855,697

DATED : August 8, 1989

INVENTOR(S) : Keith E. Jones et al.

It is certified that error appears in the above-identified patent and that said Letters Patent is hereby corrected as shown below:

Col. 3, line 66 Delete hyphen between "the" and "resilient"

Col. 4, line 38 After "can flex to" insert --maintain contact with the upper conductive strip 14.--

Col. 5, line 4 Delete comma between "the" and "foregoing"

Col. 6, line 2 Change comma to semi-colon

Signed and Sealed this

Fifteenth Day of October, 1991

*Attest:*

*Attesting Officer*

HARRY F. MANBECK, JR.

*Commissioner of Patents and Trademarks*